United States Patent [19]

Hensler

[11] Patent Number: 4,581,832

[45] Date of Patent: Apr. 15, 1986

[54] DEVICE FOR SUPPORTING A FOOT WITHIN THE INSTEP AREA AND/OR SHIN-BONE AREA OF A BOOT

[75] Inventor: Adolf Hensler, Köflach, Austria

[73] Assignee: Koflach Sportgerate Gesellschaft mbH, Vienna, Austria

[21] Appl. No.: 681,319

[22] Filed: Dec. 13, 1984

[30] Foreign Application Priority Data

Dec. 14, 1983 [AT] Austria ..... 4351/83

[51] Int. Cl.[4] ..... A43B 5/04; A43B 23/26

[52] U.S. Cl. ..... 36/119; 36/54

[58] Field of Search ..... 36/117–121, 36/50, 54

[56] References Cited

U.S. PATENT DOCUMENTS

| | | | |
|---|---|---|---|
| 4,193,215 | 3/1980 | Hensler | 36/50 |
| 4,334,368 | 6/1982 | Chalmers, II et al. . | |
| 4,406,073 | 9/1983 | Spademan | 36/119 |

FOREIGN PATENT DOCUMENTS

| | | | |
|---|---|---|---|
| 308590 | 1/1964 | Austria . | |
| 333154 | 11/1976 | Austria . | |
| 339771 | 11/1977 | Austria . | |
| 354307 | 1/1980 | Austria . | |
| 373478 | 1/1984 | Austria . | |
| 0053340 | 11/1981 | European Pat. Off. . | |
| 1806109 | 5/1970 | Fed. Rep. of Germany | 36/119 |
| 1810291 | 6/1970 | Fed. Rep. of Germany | 36/54 |
| 8101644 | 6/1981 | PCT Int'l Appl. . | |
| WO84/02258 | 6/1984 | PCT Int'l Appl. | 36/119 |
| 433055 | 5/1965 | Switzerland . | |
| 590625 | 3/1975 | Switzerland . | |

*Primary Examiner*—James Kee Chi

[57] ABSTRACT

A supporting plate (14) is provided for supporting a foot within the instep area, the bending area or the shin-bone area of a boot. The supporting plate (14) is subjected to pressure in direction to the instep and bending joint or the shin-bone, respectively, by means of an actuating member formed of a lever (6), for which purpose a pressure member (9) is provided. The pressure member (9) is linked to the lever (6) for effecting a swivelling movement and is adjustable with respect to its effective length, for which purpose either the length of the pressure member (9) itself can be changed or a plurality of points (12) of engagement is provided via which the pressure member (9) cooperates with a protrusion (13) of the supporting plate (14) or with a spring leaf extending over the supporting plate (14).

15 Claims, 3 Drawing Figures

DEVICE FOR SUPPORTING A FOOT WITHIN THE INSTEP AREA AND/OR SHIN-BONE AREA OF A BOOT

The invention refers to a device for supporting a foot within the instep area, the bending area and/or shin-bone area of a boot, in particular of a ski boot, comprising a supporting plate supported relative to the shell of the boot and being adjustable in its position.

For the purpose of maintaining the position of the foot within the shell of a ski boot it has already become known to arrange at the area of the forward end of the foot or the instep area, respectively, for example between the boot shell and the inner shoe, flexible plates, the height position of which can be adjusted from the exterior side of the shell. For adjusting these instep plates, it has already been proposed to arrange adjusting screws on the outer side of the shell. It has further become known to tighten such instep plates consisting of flexible material against the foot or the inner boot, respectively, by means of tension members and by using buckles. With these known devices it was, at best, possible to improve the seat within the instep area or to pull the foot in direction to the heel portion. Any support of forces generated on occasion of a forwardly inclined position, i.e. forces occurring when swivelling the leg in forward direction, is not easily achievable with these known constructions.

The invention now aims at improving the seat of the foot within a boot shell and to obtain, above all, within the mentioned area of the boot an exact adaptation to and support of forces generated in forwardly inclined position, which adaptation and support is, according to experience, subject to the greatest individual variations. The device according to the invention thus primarily aims at offering an exact support and at improving the holding within the lower shaft area to keep the upper shaft area free of constricting adaptation forces. For solving this task, the device according to the invention essentially consists in that a pressure member is provided which extends substantially in longitudinal direction of the boot and can be brought in operative connection with the supporting plate and which has its actuating member located on the exterior side of the shell and the active length of which can be changed and adjusted. On account of providing a pressure member substantially extending in longitudinal direction of the boot and having its effective length variable and adjustable and being suitable to be accommodated in a particularly stable manner within the instep area of a closed shell, supporting forces exerted in longitudinal direction of the shell are transmitted into the shell and can thus reliably be received by the shell without substantial deformation of the shell. This construction is of particular advantage in connection with ski boots of the type in which the forward area of the boot is closed in itself and the foot is introduced after having swivelled away a swivellable stern portion. It is just with such constructions of a ski boot that the sleeve portion and the stern portion of the boot are each designed as a half-shell and are swivelable relative to the boot shell. The deformability of such half-shells and the swivelability of such half shells relative to the shell is, however, responsible for the fact that such boots are insufficiently suitable to receive the supporting forces via these construction parts. In contrast thereto, the instep area of a ski boot comprising a closed shell is extremely stable against deformation and provides a reliable support of the plate which is, in particular, arranged within the bending area and the shin-bone area.

The actuating member, which must be accessible at the exterior side of the shell, can in a simple manner be designed as an annular nut into which can be screwed a threaded bolt of the pressure member. It is, however, also possible to design the pressure member as a hydraulic or pneumatic cylinder-piston aggregate provided with a supply means or pump for pressurized fluid actuable from the exterior side.

In a particularly preferred manner, the arrangement is, however, such that the actuating member is formed of a swivelable lever within the instep area of the shell, the swivelling axis of said lower extending substantially in transverse direction relative to the longitudinal axis of the boot, and that the lever has the pressure member, which cooperates with the supporting plate, at its side facing the shell. By means of such a swivelable actuating means, any desired leverage can be adjusted in dependence on the distance of the linking point of the swivelable lever on the shell, and the point of engagement of the pressure member on the lever and a relatively high pressure force can be generated with a relatively low exerted force. With such an embodiment, the pressure member can be designed as a resilient tongue or be linked in a simple manner to the lever for being swivelable around an axis parallelly extending relative to the swivel axis of the lever, so that manipulation and adjusting of the effective length is substantially simplified.

In a particularly advantageous manner, the pressure member is length-adjustable and adjustable and preferably has at least one bolt which can be threaded into a female thread. The pressure member is easible accessible after having swivelled the swivelable lever, and it is just for this reason that the length adjustment be effected in a simple manner at this place.

Because the supporting plate is preferredly arranged between the shell and the inner boot above the instep area proper, force transmission from the pressure member onto the supporting plate is in an advantageous manner reliably obtained if the supporting plate carries a, preferably resilient, protrusion, the free end of which can be brought into operative connection with the pressure member. The resiliently designed protrusion primarily serves the purpose of uniformily transmitting the forces to the supporting plate which can even be made of flexible material. On account of the resilient load transmission, any local excessive stress and pressure areas are avoided and the pressure transmitted from the pressure member to the supporting plate is reliably and uniformely distributed over the surface area of the pressure plate.

For rough pre-adjustment of the desired pressure acting on the supporting plate, the free end of the protrusion may, according to a preferred embodiment, comprise at least two points of engagement for the pressure member, said points of engagement being located one beside the other in axial direction of the protrusion and in particular having the shape of saw-teeth as seen in a longitudinal direction, noting that fine adjustment can then be effected immediately on the pressure member itself.

A further improvement of load transmission into the pressure plate can be achieved if the protrusion is articulated to the supporting plate, noting that a particularly simple construction can be realized if the protrusion is designed as a spring steel band or spring steel rod.

For preventing any unintended shift of the supporting plate within the interior of the shell, it is of advantage to support or link, respectively, the supporting plate at a distance from the point of engagement of the protrusion or of a constructional part cooperating with the pressure member, respectively, on the interior side of the shell. Also by this measure, a maximum uniform load distribution is primarily obtained within the sensible bending area and shin-bone area.

For facilitating operation and for facilitating the adjustment of the effective length of the pressure member, the arrangement is in a particularly advantageous manner such that the pressure member is resiliently supported on the lever in direction to the shell around its swivel axis on the lever. For the purpose of relieving the bending area and shin-bone area for a short time, for example during standing, it is of particular advantage if the arrangement is such that the pressure member can—with its free end located opposite the point of engagement or the linking point to the lever—be brought in a releasable form-locking connection with the points of engagement on the protrusion. In this manner it is not necessary to again seek the correct position after a short period of relief and it is sufficient to again press the actuating member formed of a lever into its closing position. This construction simultaneously serves the purpose of facilitating fine adjusting the length of the pressure member itself, because—with the lever assuming open position—the adjusting members for the length-adjustment arrive at a defined position on account of the form-locking connection with the points of engagement of the protrusion and the adjusting members are well accessible in this defined position. Simultaneously, such a form-locking connection with the points of engagement on the protrusion has as an effect that—on opening the lever—the load relief within the area of the supporting plate is assisted by the opening movement of the lever, because the supporting plate is—during such opening movement—subjected to tension stress in case of a form-locking connection with the pressure member.

In a particularly advantageous and attractive manner, the actuating member, in particular the swivelable lever, may enter in its closed position a recess in the shell, so that a smooth and stream-lined outer contour of the boot is obtained. For facilitating manipulation of an actuating member preferably formed of a lever, the free end of the lever preferably has an actuation recess or a two-armed auxiliary lever, the inwardly directed arm of which cooperates with the bottom of the recess accommodating the lever. In this manner, the lever can be brought into a swivelled position facilitating complete opening of the lever by either gripping into the actuating recess or by actuating the auxiliary lever.

For the purpose of reliably maintaining a favourable pressure distribution within the supporting plate, the arrangement can, as an alternative of the feature to provide the supporting plate with a resilient protrusion, be such that the pressure member cooperates with a spring leaf fixed with its free end to the shell or to the sleeve and at least partially extending over the supporting plate. In this arrangement, the pressure member results in vaulting the spring leaf and thus in distributing and transmitting the pressure acting on the supporting plate over a greater area of the supporting plate. As already mentioned, the supporting plate itself can be supported on the shell or on the sleeve, respectively. In this case and in an advantageous manner, the linking point for linking the supporting plate to the inner side of the shell is designed to be height-adjustable, noting that—particularly if this linking point is arranged at the forward end portion of the supporting plate—a more exact setting is also possible in the forward foot area.

In the following, the invention is further explained with reference to embodiments shown in the drawing.

In the drawing

Figure 1:
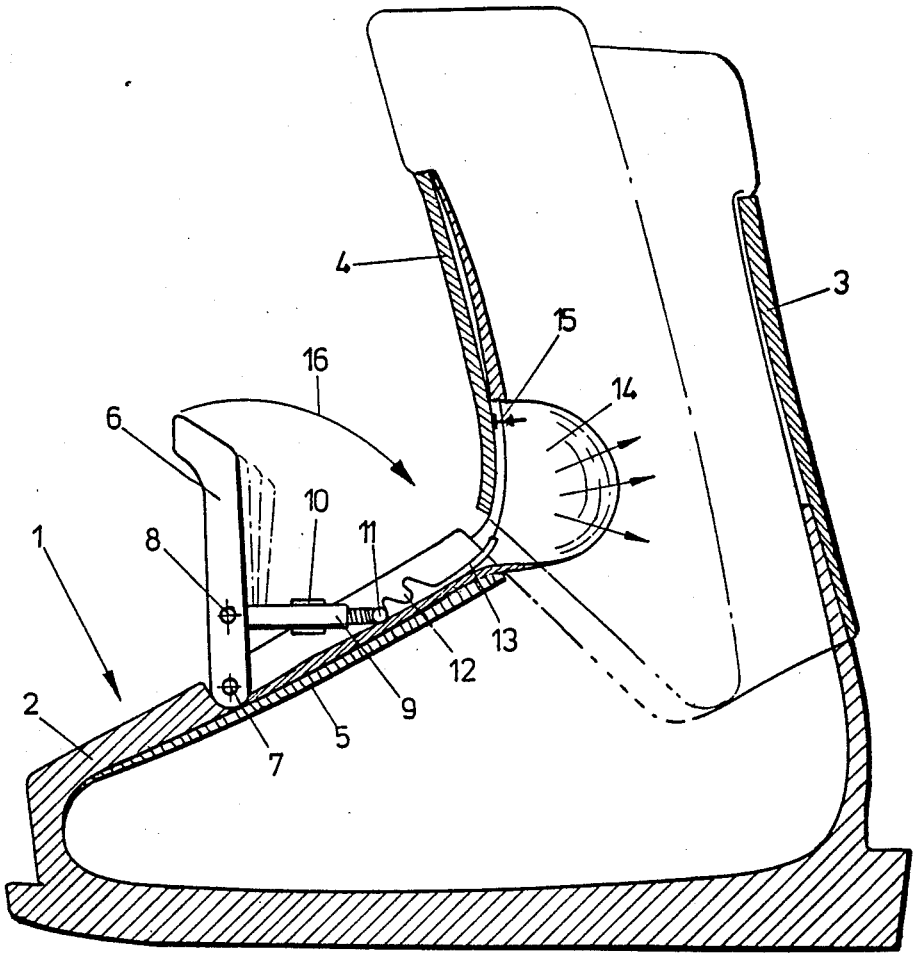
FIG. 1 shows a longitudinal section through a boot comprising a first embodiment of the device according to the invention.

The shell of a ski boot 1 is designated by 2 in FIG. 1. A stern flap 3 and a sleeve 4 are swivelably linked to this shell 2, the corresponding swivel axis being approximately located in the ankle area of the boot. An inner boot 5 is arranged within the shell 2.

A swivelable lever 6 is arranged within the area of the forward foot or instep area of the boot 2 and has its swivel axis 7 extending in substantially transverse direction to the longitudinal plane of the boot 1. A pressure member 9 of adjustable length is linked to the actuating lever 6 for swivelling movement around an axis 8 substantially parallelly extending relative to the swivel axis 7. The adjusting means is schematically indicated by a threaded sleeve or nut 10 into which enter the bolt threads of both components of the pressure member.

The free end 11 of the pressure member 9 acts on engaging points 12 of a resilient protrusion 13. The protrusion 13 is connected with a supporting plate 14 made of an elastically deformable material.

The supporting plate 14 contacts the inner boot 5 at the side of the shin-bone and is supported on the shell at 15. Swivelling movement of the lever 6 in the direction of the arrow 16 results—with interposition of the pressure member 9 and the resilient protrusion 13—in subjecting the pressure plate 14 to pressure load and thus in improving the seat of a foot within the inner boot 5.

The points 12 of engagement provided on the resilient protrusion 13 have, in the emobidment shown and as seen in longitudinal direction, the shape of saw teeth, so that the desired pressure acting on the supporting plate 14 can roughly be adjusted at this location. The free end 11 of the pressure member 9 can exert its action in a force-locking manner only in direction of any acting pressure. However, it is advantageous to provide a releasable form-locking connection, so that the pressure member 9 arrives—when opening the lever 6 is opposite direction to the direction of the arrow 16—at a defined position in which the adjusting member or the threaded sleeve 10, respectively, can be actuated in a particularly simple manner. The resilient protrusion 13 may be guided at the inner side of the shell against any lateral dislocation so that it is possible to exactly introduce the acting pressure.

Figure 2:
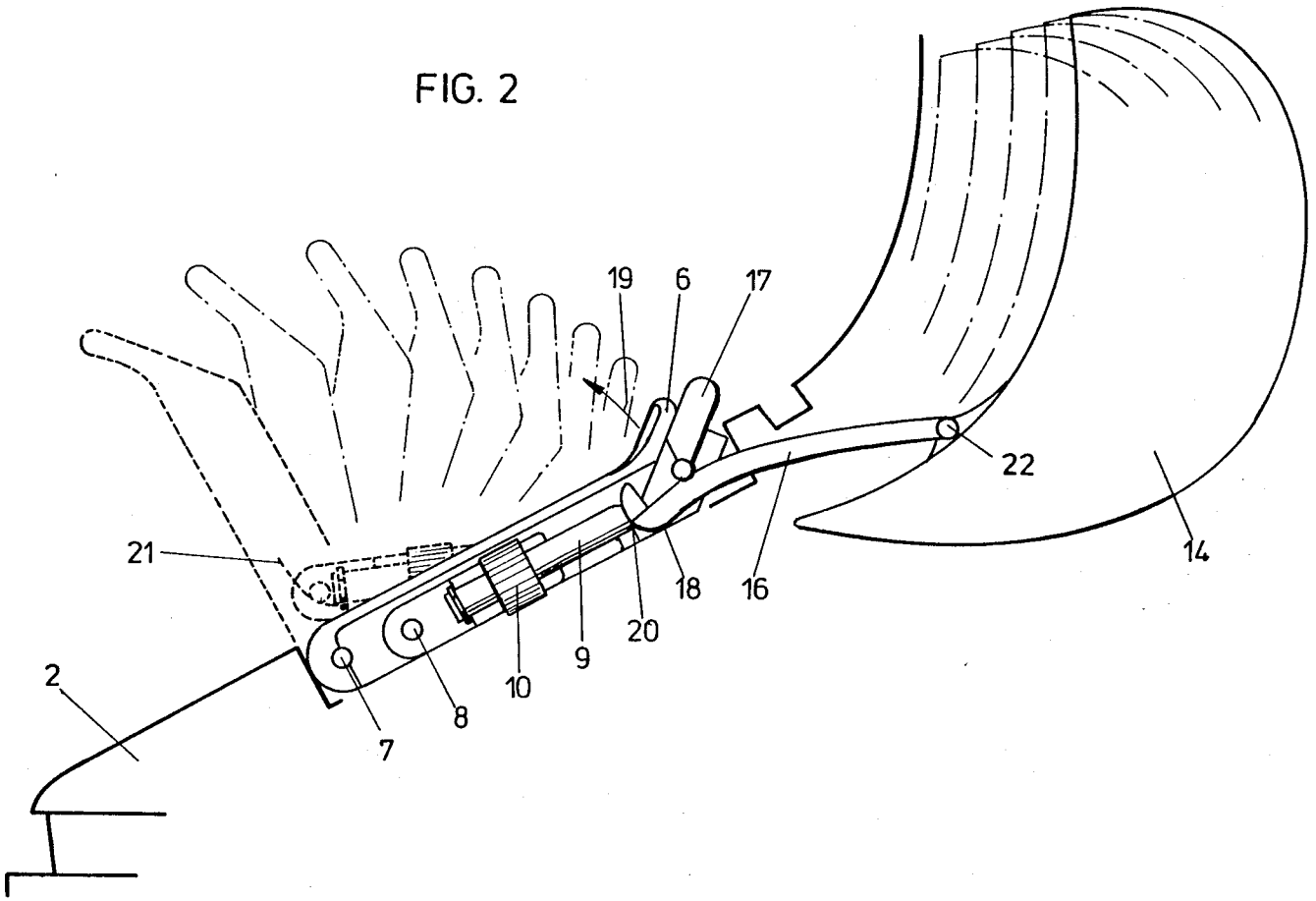
FIG. 2 shows in an enlarged scale a partial view of the instep area of such a boot comprising a modified embodiment of the device according to the invention and FIG. 3 shows a further modified embodiment.

In the embodiment shown in FIG. 2, the forward end portion of the shell 2 is shown. The supporting plate 14 is connected with a protrusion 16 via a pivotal point 22, this protrusion 16 again being designed as a spring band or spring rod, if this is desired. The actuating lever is again designated by 6 and linked for swivelling movement around the axis 7 to the forward area of the shell.

This actuating lever 6 cooperates with its free end with a lever 17 which is pivotally linked to the shell, for example in proximity of the bottom 18 of a recess. By swivelling this lever 17, the lever 6 is lifted in direction of the arrow 19. Simultaneously, this lever 17 provides the possibility to guide the protrusion 16 in closed position of the lever 6. After such lifting movement, the lever 6 can be swivelled into the opened position shown in dashed lines, noting that the swivel axis 8 of the pressure member 9 arrives at a position corresponding to the representation according to FIG. 1. Also with this embodiment, the pressure member is again provided with a threaded bolt which can be threaded into a nut 10 so that the effective length of the force transmission between the lever 6 and the flexible supporting plate 14 can be changed. With such an embodiment, there exists only a pressure-locking contact between the pressure member 9 and the free end of the protrusion 16, so that the free end of the pressure member 9 comes out of engagement with the crowned free end 20 of the protrusion 16 when opening the lever 6. For the purpose to make sure that in the course of a closing operation the desired pressure is again transmitted, a spring 21 is now in an advantageous manner provided on the swivel axis 8 of the pressure member 9, said spring maintaining the free end of the pressure member 9 in contact with the bottom 18 of the recess accommodating the lever 6.

Figure 3:
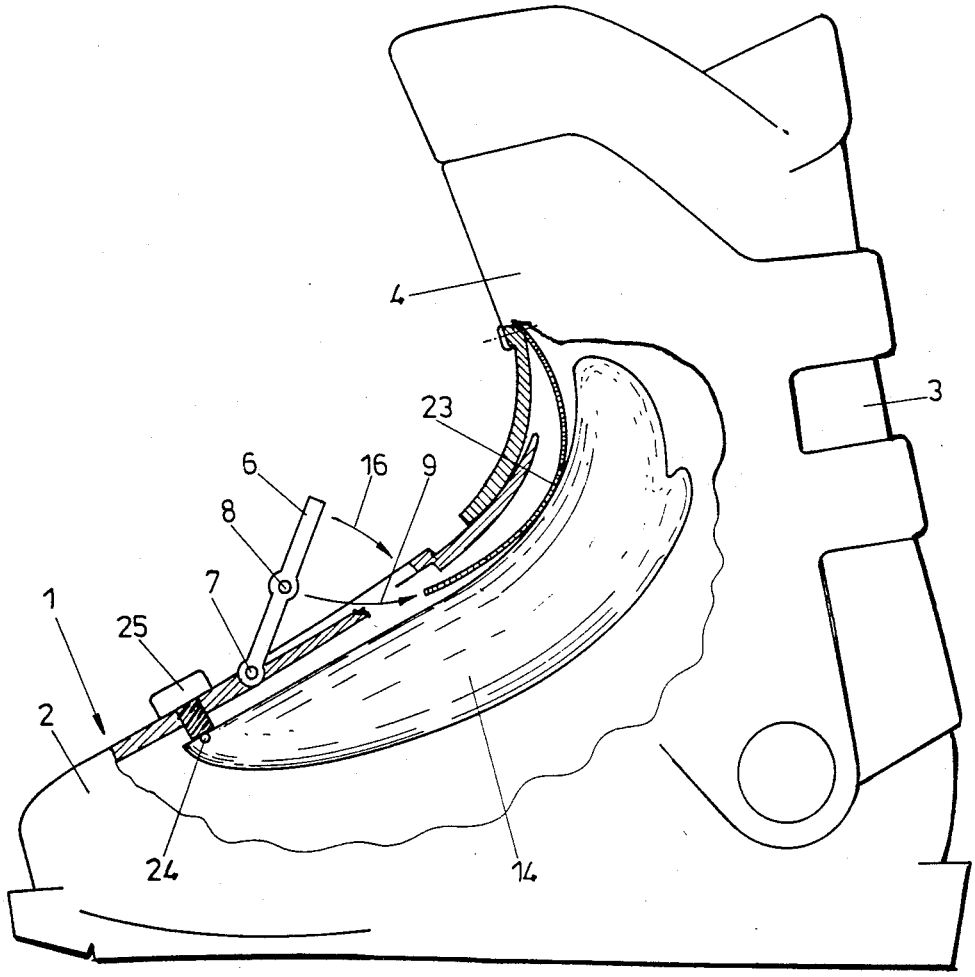

FIG. 3 shows a modified embodiment, partially in a section, in an analogous manner to the representation in FIG. 1. The pressure member 9 is only schematically indicated and cooperates with a spring leaf 23 extending over the supporting plate at least within the upper area. When actuating the lever 6 in direction of the arrow 16, the pressure member 9 causes vaulting of the spring leaf 23 in direction to the supporting plate 14 and thus causes uniform force introduction into a greater area of the supporting plate 14.

In the forward end area, the supporting plate 14 is fixed to the shell 2 via a swivel axis 24. This swivel axis 24 can be adjusted in height direction by means of a screw 25 for achieving a more exact adaptation within the forward foot area.

What is claimed is:

1. Device for supporting a foot within the instep area, the bending area and/or the shin-bone area of a boot, in particular of a ski boot, comprising an elastically deformable supporting plate supported relative to the shell of the foot and being adjustable in its position, characterized in that a pressure member (9) is provided which extends substantially in longitudinal direction of the boot and can be brought into operative connection with the supporting plate (14) said member being operatively related to an actuating member (6) located on the exterior side of the shell (2), said actuating member being operable to cause the pressure member to impart a force on said supporting plate in a direction substantially longitudinally of the boot for adjusting said plate, the active length of said pressure member being adjustable.

2. Device as claimed in claim 1, characterized in that the actuating member (6) is formed of a swivelable lever within the instep area of the shell (2), the swivelling axis (7) of said lever extending substantially in transverse direction relative to the longitudinal axis of the boot, and in that the lever (6) has the pressure member (9), which cooperates with the supporting plate (14), at its side facing the shell (2).

3. Device as claimed in claim 2, characterized in that the pressure member (9) is linked to the lever (6) for swivelling movement around an axis (8) parallelly extending relative to the swivel axis (7) of the lever.

4. Device as claimed in claim 1 in that the pressure member (9) is length-adjustable and setable and preferably comprises at least one bolt adapted to be screwed into a female thread.

5. Device as claimed in claim 1, characterized in that the supporting plate (14) carries a, preferably resiliently designed, protrusion (13), the free end of which can be brought in operative connection with the pressure member (9).

6. Device as claimed in claim 5, characterized in that the free end of the protrusion (13) comprises at least two points (12) of engagement for the pressure member (9), said points of engagement being located one beside the other in axial direction of the protrusion (13) and in particular having the shape of saw-teeth as seen in a longitudinal direction.

7. Device as claimed in claim 5, characterized in that the protrusion (16) is articulated connected with the supporting plate.

8. Device as claimed in claim 5, characterized in that the protrusion (13, 16) is designated as a spring steel band or spring steel rod.

9. Device as claimed in claim 1, characterized in that the supporting plate (14) is supported or pivotally linked, respectively, to the inner side of the shell at a distance from the point of engagement (12, 22) of the protrusion (13, 16) or of a constructional part (23) cooperating with the pressure member respectively.

10. Device as claimed in claim 1, characterized in that the pressure member (9) is resiliently supported on the lever (6) in direction to the shell (2) around its swivel axis (8) on the lever (6).

11. Device as claimed in claim 1, characterized in that the pressure member (9) can—with its free end (11) located opposite the point (8) of engagement or linking to the lever—be brought in releasable form-locking connection with the points (12) of engagement on the protrusion (13).

12. Device as claimed in claim 1, characterized in that the actuating member, in particular the swivelable lever (6), enters in its closed position a recess in the shell.

13. Device as claimed in claim 12, characterized in that the free end of the lever (6) carries an actuation recess or a two-armed auxiliary lever (17), the inwardly directed arm of which cooperates with the bottom (18) of the recess accommodating the lever (6).

14. Device as claimed in claim 1, characterized in that the pressure member (9) cooperates with a spring leaf (22) fixed with its free end to the shell or to the sleeve and at least partially extending over the supporting plate (14).

15. Device as claimed in claim 1, characterized in that the linking point (24) for linking the supporting plate (14) to the inner side of the shell is designed to be height-adjustable.

* * * * *